US009502229B2

(12) United States Patent
Scime et al.

(10) Patent No.: US 9,502,229 B2
(45) Date of Patent: Nov. 22, 2016

(54) ULTRA-COMPACT PLASMA SPECTROMETER

(71) Applicants: West Virginia University, Morgantown, WV (US); Advanced Research Corporation, White Bear Lake, MN (US)

(72) Inventors: Earl Scime, Morgantown, WV (US); Amy M. Keesee, Bridgeport, WV (US); Drew B. Elliot, Morgantown, WV (US); Matthew Phillip Dugas, North Oaks, MN (US); Steven Brian Ellison, Woodbury, MN (US); Joseph Christopher David Tersteeg, Columbia Heights, MN (US)

(73) Assignees: WEST VIRGINIA UNIVERSITY, Morgantown, WV (US); ADVANCED RESEARCH CORPORATION, White Bear Lake, MN (US)

( * ) Notice: Subject to any disclaimer, the term of this patent is extended or adjusted under 35 U.S.C. 154(b) by 0 days.

(21) Appl. No.: 14/691,685

(22) Filed: Apr. 21, 2015

(65) Prior Publication Data

US 2015/0311054 A1 Oct. 29, 2015

Related U.S. Application Data

(60) Provisional application No. 61/984,926, filed on Apr. 28, 2014.

(51) Int. Cl.
*H01J 49/26* (2006.01)
*H01J 49/48* (2006.01)

(52) U.S. Cl.
CPC ..... *H01J 49/48* (2013.01)

(58) Field of Classification Search
USPC ..... 250/281, 282, 283, 288
See application file for complete search history.

(56) References Cited

U.S. PATENT DOCUMENTS

| | | | | |
|---|---|---|---|---|
| 4,296,323 | A | 10/1981 | Gerlach | |
| 2003/0020010 | A1* | 1/2003 | Cornish | H01J 49/40 250/287 |
| 2008/0242980 | A1 | 10/2008 | Lees et al. | |

OTHER PUBLICATIONS

International Search Report and Written Opinion for related application No. PCT/US 15/27927 mailed Mar. 30, 2016.

(Continued)

*Primary Examiner* — Nicole Ippolito
(74) *Attorney, Agent, or Firm* — Thomas|Horstemeyer, LLP.

(57) ABSTRACT

Various examples are provided for collimator assemblies and/or energy analyzer arrays of plasma spectrometers. In one example, among others, an ultra-compact plasma spectrometer includes a collimator assembly; an energy analyzer array that receives charged particles from the collimator; and a detector plate that detects charged particles exiting the energy analyzer array. The energy analyzer array can include a plurality of analyzer plates having distinct energy channels. In another example, a method includes bonding a stack of analyzer plates to form an energy analyzer array, affixing a collimator assembly to the entrance surface of the energy analyzer array, and affixing an array of detectors to the exit surface of the energy analyzer array. The analyzer plates include energy analyzer bands extending from the entrance surface to the exit surface. The aperture arrays and the detectors can align with the energy analyzer bands.

20 Claims, 15 Drawing Sheets

(56) References Cited

OTHER PUBLICATIONS

Bedington, "A prototype Cylindrical and Tiny Spectrometer for the rapid energy analysis of space plasmas." Mullard Space Science Laboratory, Oct. 2012, pp. 76, 80-81, 85, 88-89, 144-145, 158, 184-186, 208.

Beetz, Miniature Flat Plasma Spectrometer Project. Tech port, 2004, pp. 1.

* cited by examiner

FIG. 3C
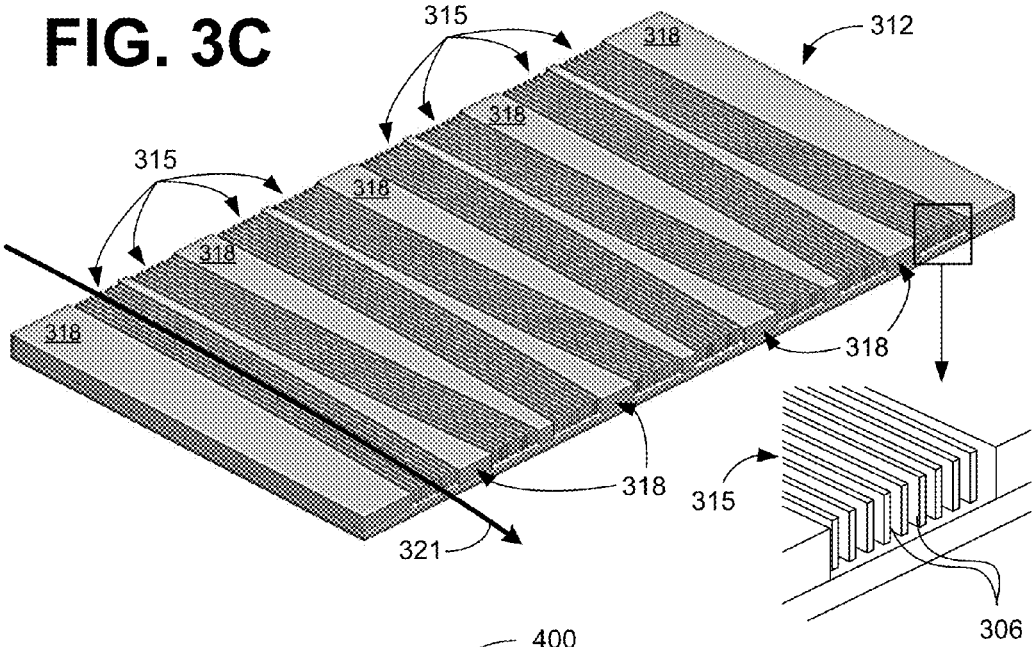
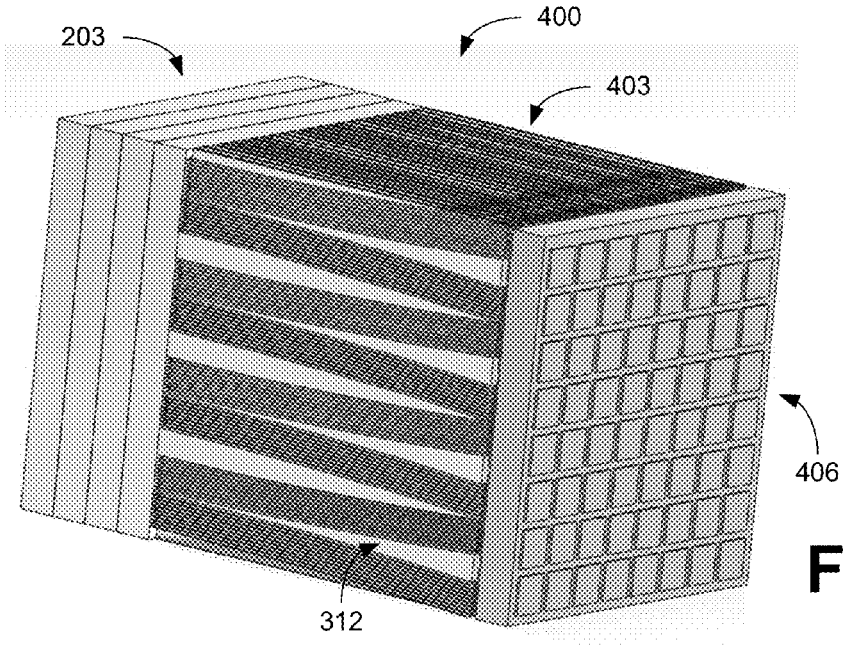
FIG. 4

ENTRANCE SIDE OF ETCHING PROCESS

206

EXIT SIDE OF ETCHING PROCESS, 320 μm LATER

206

See cross-sectional view of FIG. 7F

709

ULTRA-COMPACT PLASMA SPECTROMETER

CROSS REFERENCE TO RELATED APPLICATIONS

This application claims priority to, and the benefit of, U.S. provisional application entitled "ULTRA-COMPACT PLASMA SPECTROMETER" having Ser. No. 61/984,926, filed Apr. 28, 2014, which is hereby incorporated by reference in its entirety.

STATEMENT REGARDING FEDERALLY SPONSORED RESEARCH OR DEVELOPMENT

This invention was made with government support under agreement NNX10AN08A awarded by the National Aeronautics and Space Administration. The Government has certain rights in the invention.

BACKGROUND

Beginning with single spacecraft and progressing to recent multi-spacecraft missions, exploration of near-Earth space has increasingly focused on understanding the energy flow and coupling between different spatial regions through simultaneous measurements of essential plasma parameters, e.g., magnetic field, electric field, density, and temperature, over the relevant spatial length scales. The next step in multi-spacecraft missions is to go beyond missions consisting of a handful of large and sophisticated spacecraft to missions comprising large numbers of simple micro or pico-spacecraft.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 3A and 3C are graphical representations of examples of curved plate analyzers in accordance with various embodiments of the present disclosure.

FIG. 4 is a graphical representation of an example of an ultra-compact plasma spectrometer in accordance with various embodiments of the present disclosure.

DETAILED DESCRIPTION

Figure 1:
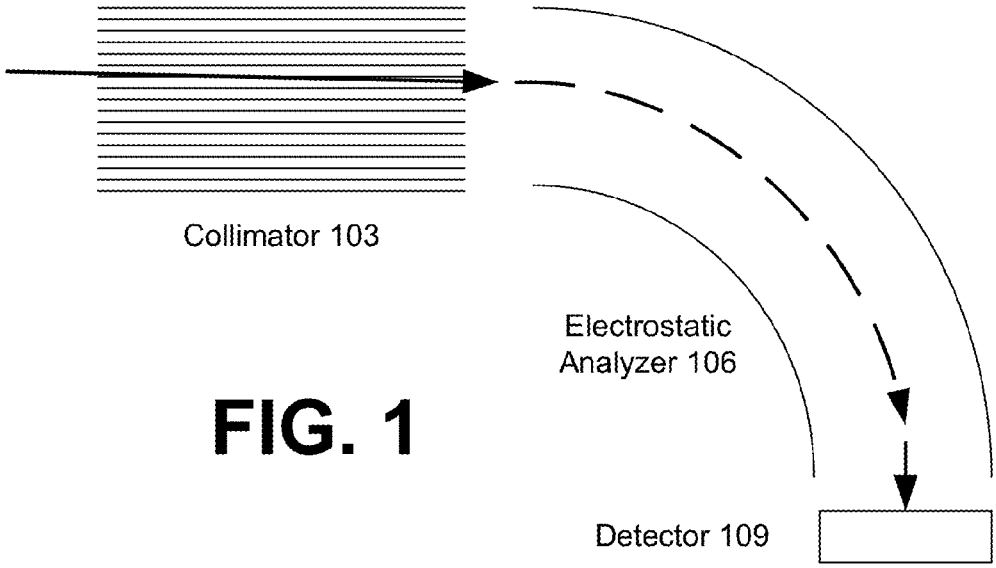
FIG. 1 is a functional schematic illustrating an example of a plasma spectrometer in accordance with various embodiments of the present disclosure.

Disclosed herein are various examples related to plasma spectrometers that, for example, can be used for heliophysics. Reference will now be made in detail to the description of the embodiments as illustrated in the drawings, wherein like reference numbers indicate like parts throughout the several views.

The plasma and energetic particle environment of Sun-Earth space encompasses a wide range of dynamic phenomena and structures at all spatial scales, e.g., shocks, discontinuities, magnetic flux convection, plasma heating, flux rope formation, and magnetic reconnection. To fully investigate these structures and phenomena, identical plasma spectrometers can be deployed on multiple spacecraft which simultaneously traverse these structures and phenomena. For example, the proposed DRACO Magnetospheric Constellation mission is anticipated to consist of up to one hundred spacecraft with a size of about 10-20 kg, each with a power budget of 10 W, that are deployed in highly elliptical, equatorial orbits with common perigees of 3 $R_E$ and apogees distributed from 7-40 $R_E$. By flying up to 100 spacecraft, it is possible to resolve the magnetotail as a coupled whole by making dense vector field and plasma measurements over a large portion of the entire magnetosphere. In view of the constraints envisioned for microsatellites (e.g., a total mass less than 10 kG and a total power less than 5 W), low voltage ultra-compact plasma spectrometers can be used to obtain the measurements.

Current generation ion spectrometers, mass spectrometers and related instruments that measure the mass-to-charge ratio of energetic particles, which may be collectively referred to as ion or plasma spectrometers, are too large and too high in power consumption to be deployed on many of these next generation small satellite missions. Instead, micro-sized low power plasma spectrometers can be utilized in these small satellites. Other applications for these ultra-compact plasma spectrometers include miniaturized instrumentation in fields such as semiconductor processing, plasma physics, nuclear fusion chamber, or other applications where size, mass, and/or power consumption requirements may be satisfied by these ultra-compact plasma spectrometers. For example, the size may allow one or more micro-sized plasma spectrometer(s) to be positioned to make a measurements in semiconductor processing chambers or in a plasma fusion reactor, or in various analytical instruments, all of which may have a relatively low pressure environment and energetic charged particles. With the addition of magnetic field biasing, ionization capabilities and/or micro-sized vacuum pumps in various combinations, the ultra-compact low power plasma spectrometers can be included in a broader range of applications which may require mass-to-charge measurement and analysis.

A plasma spectrometer can include three elements: a collimating structure that defines the viewing geometry of the instrument and, ideally, can provide partial or complete shielding of the instrument from sunlight; an energy per charge or energy per mass resolving analyzer; and a particle detector. FIG. 1 is a functional schematic of an example of an energy per charge resolving plasma spectrometer. The collimator 103 restricts the field of view (or angular resolution) of the instrument. The mass or energy per charge resolving analyzer (or energy analyzer) 106 selects specific portions of the particle velocity or mass distribution (and separates the particles from any photons entering the instrument). In this way, an electrostatic analyzer 106 can distinguish species and eliminate background photons. The particles can then be detected by a detector 109 using a variety of possible techniques known in the art. In some embodiments, the collimating section and the energy analyzer section can be designed and fabricated at wafer scale using semiconductor, thin film and MEMs level processing techniques. For example, the collimator section and the energy analyzer sections are fabricated with lithographic patterning, high aspect ratio deep reactive ion etching (DRIE), thin film deposition and patterning and 3D chip stacking (hybridization). In combination with a wafer scale silicon solid state detector (SSSD), these three solid state wafer scale fabricated sections lead to the development and realization of an ultra-compact plasma spectrometer.

The collimator 103 serves to limit the field of view (or angular resolution) of the instrument and may also define the energy range and energy resolution of the plasma spectrometer. Consider a standard grating-based optical spectrometer. The entrance and exit slits determine the wavelength resolution of the instrument if and only if the light rays falling on the entrance slit are all parallel. Selection of only parallel, or nearly parallel, rays is accomplished by either placing the light source very far away from the entrance slit or by using an optical element to create a beam of parallel rays. The collimator 103 of a plasma spectrometer serves the same purpose. Additionally, the plasma collimator 103 is typically configured to avoid creating a cloud of photoelectrons liberated by solar irradiance at the entrance aperture of the instrument, reject charged particles at energies much lower or much higher than the design energy range of the spectrometer, and/or shield the particle detectors from direct sunlight.

Figure 2:
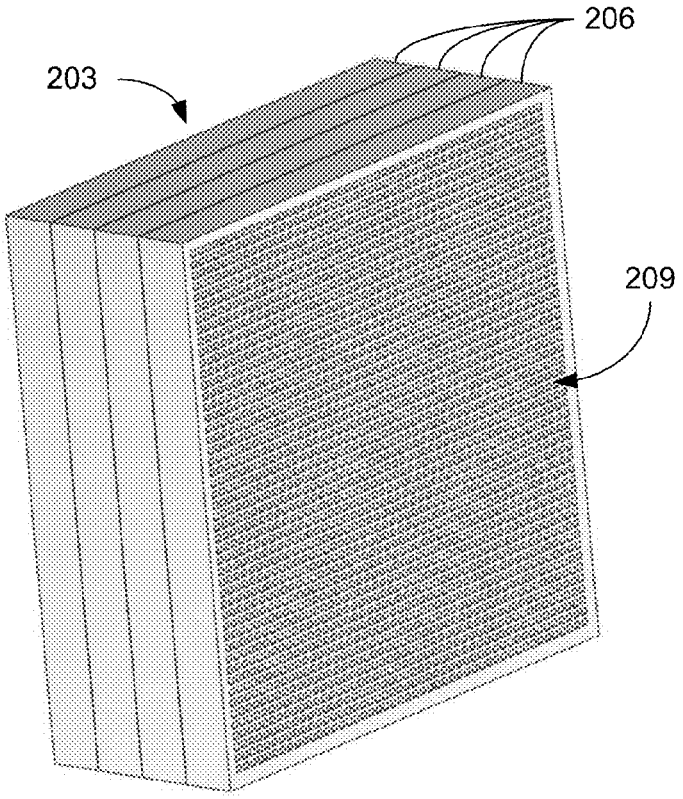
FIG. 2 is a graphical representation of an example of a collimator assembly of FIG. 1 in accordance with various embodiments of the present disclosure.

Referring to FIG. 2, shown is a schematic representation of an example of a collimator assembly 203 that includes four layers 206 of single crystal silicon wafers (or chips) comprising an array of 50 μm×50 μm holes (or apertures) 209. The apertures 209 can be substantially rectangular (see, e.g., the images of FIGS. 7C-7E) with a dimension of about 50 μm×50 μm or less. Deep reactive ion etching techniques can be used to fabricate the collimating aperture 209 of 50 μm×50 μm through, e.g., 400 μm thick single crystal silicon wafers 206. Although the holes will be too large to reject sunlight, the 8:1 aspect ratio necessary for good collimation is feasible with commercially available etching methods. For a hole-to-hole spacing of 75 μm in both directions, the resultant collimator transparency is 44%. This is an order of magnitude larger than the transparency of the collimator developed for the WISPER plasma instrument. See, e.g., "Design, fabrication, and performance of a micromachined plasma spectrometer" by D. M. Wesolek et al. (Microfab., Microsys., Vol. 4, p. 41403 (2005)). An aligned stack of four such wafers 206 limits the angular acceptance of each collimator aperture 209 to ±2° in both angular directions. The target size for the collimating structure 203 is a 1 cm×1 cm plate. Each collimator layer (wafer or chip) 206 can be fabricated in a single etching step and can include alignment pins for assembly into the complete collimating structure 203 of FIG. 2.

In some implementations, the collimator 103 (FIG. 1) may be fabricated from a single 1600 μm thick plate with the same overall angular acceptance as four 400 μm plates. The large aspect ratio structure may be created by etching along the crystal planes of single crystal silicon. In this way, the need to join the separate collimator layers 206 (FIG. 2) together can be eliminated, resulting in a collimator 103 that is structurally more robust. However, the collimator holes (or apertures) themselves may not be perfectly square. For ease of calibration, the cross section of the holes may be a slight parallelogram with the diagonals of the parallelograms aligned with each angular direction of the instrument).

Because there advantages to restricting the angular acceptance of the collimator 103, in some implementations the collimator hole size may be reduced to less than 60 μm on a side while maintaining an angular acceptance of ±2°. Since the collimator 103 may not preferentially block light over particles, the energy analyzer 106 (FIG. 1) can provide light rejection capability to avoid saturation of the detector 109 (FIG. 1) by background light.

Figure 3A:
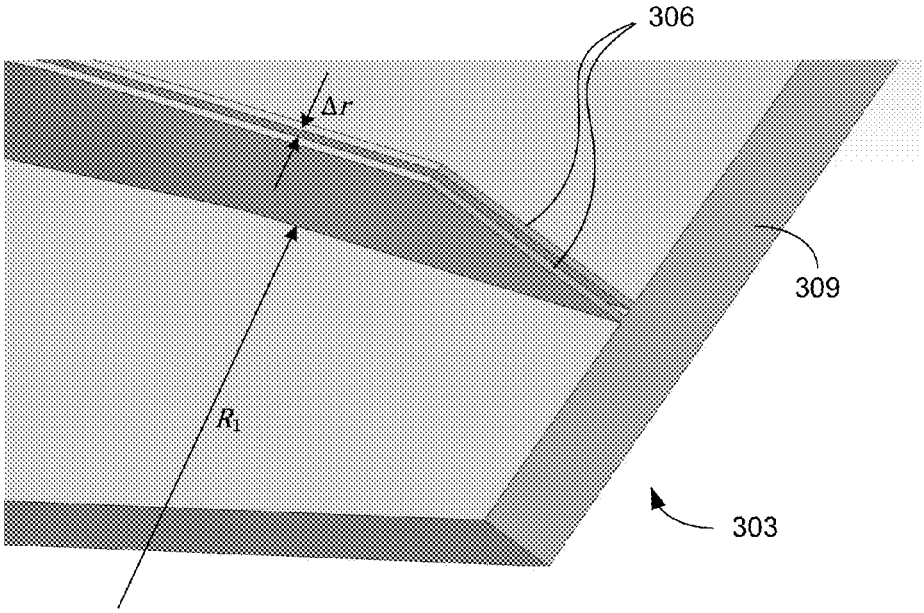

The energy analyzer 106 can utilize a curved plate configuration including clusters (or energy analyzer bands) of channels defined by curved plates. FIG. 3A is a graphical representation of an example of a single curved plate analyzer 303 including channel between a pair of curved conduction plates 306 resting on a non-conducting substrate 309. For a fixed bias voltage difference (ΔV) between the plates 306, the energy selected by a curved plate analyzer is:

$$E=q\Delta V/2\ \ln(1+\Delta r/R_1),$$

where $R_1$ is the inner plate radius and Δr is the plate spacing. For closely spaced plates 306, the transiting energy reduces to $E=qR_1\Delta V/2\Delta r$ (to the first order), i.e., the energy scales with the radius of the analyzer ($R_1$) divided by twice the plate spacing (2Δr).

The focusing properties of a cylindrical curved plate analyzer 303 are optimal for a bending angle of 127°. At this angle, charged particles injected at the center of the conduction plates 306 but with a wide range of incident angles successfully pass through the analyzer 303 and are focused upon exiting the analyzer 303. Manufacturing constraints, and the need to maximize the size of the input aperture, may limit or set the scale of the spacing between the curved plates. By combining the energy scaling advantages of a curved plate analyzer with nanoscale manufacturing, an electrostatic analyzer 106 capable of selecting 20 keV ions without a high voltage power supply and with a high throughput can be constructed.

Figure 3B:
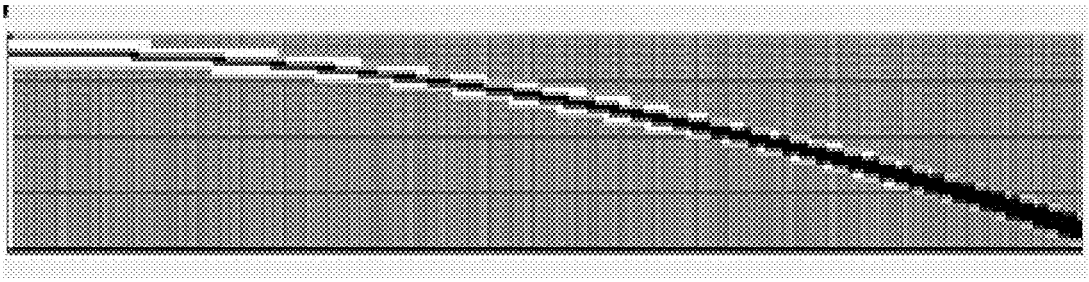
FIG. 3B illustrates 3D SIMION™ simulation results of curved plate analyzers in accordance with various embodiments of the present disclosure.

Referring to FIG. 3B, shown is a 3D SIMION™ simulation of the analyzer structure of FIG. 3A with the trajectories of 20 keV ions. The vertical scale has been stretched so that the particle tracks are visible. For the simulation, the pair of curved conduction plates 306 have a plate spacing (Δr) of 40 μm, and a plate height of 300 μm, with a curve radius to plate spacing ratio ($R_1/\Delta r$) of 3,750. The curved conduction plates 306 are resting on non-conducting substrate that is 100 μm thick. The ions (ranging from 19.1 keV to 21.3 keV) are injected from the left at the midpoint of the two curved plates 306. For a potential difference across two plates of only 10.7 V, 20 keV ions are transported from the entrance surface to the exit surface; all particles make it through the analyzer. The limited angular range of the curved plate analyzer (much less than 120°) introduces significant optical aberration into the trajectories of the transiting ions, but the angular range is sufficient to prevent a direct path for photons, i.e., the instrument geometry has at a least a one bounce path for light.

FIG. 3C shows an example of an analyzer plate 312 including an array of 8 clusters (or energy analyzer bands) 315 of 9 pairs of curved plates 306. Deep Reactive Ion Etching (DRIE) can be used on silicon to fabricate, e.g., a 1 cm×1.85 cm array of nested, 350 μm high, curved plate analyzers in a highly conductive doped silicon layer atop a 200 μm thick insulating wafer (a standard silicon-on-insulator wafer). This wafer-to-wafer double wafer substrate may have the lower wafer made of SOI or a glass wafer. In one implementation 100 mm wafers are used with a high conductivity upper wafer and a SOI lower wafer. For example, the curved plates 306 can ideally be about 10 μm thick and spaced 80 μm apart yielding a form factor of approximately 1 cm×1 cm. All have the same spacing, but are broken up into eight distinct clusters 315 of 9 curved plates so that each cluster 315 can be biased independently. The energy analyzer bands (or clusters) 315 are separated from each other by an electrode 318. This combination of electrodes 318 and conduction plates 306 results in 10 adjacent 80 μm wide transmission channels per band. The eight clusters 315 alternate in orientation so that the outer plate of one cluster 315 shares a common electrical potential with the outer plate of the adjacent cluster. This configuration provides adequate space for electrical connections to the electrodes 318 and leaves large regions of material in the conductive layer for structural strength.

In the example of FIG. 3C, ions enter the slots between the curved plates 306 from the left side of the analyzer plate 312 and exit from the right side as illustrated by arrow 321. Ideally, the inner plates of each cluster (or energy analyzer bands) 315 would be biased through capacitive coupling to adjacent plates. If direct electrical connections are needed, electrical interconnects may be included or modified to permit direct electrical connections to each of the inner plates. For N plates in an energy analyzer band 315 and the capacitive coupling biasing option, the voltage difference across each pair of conduction plates 306 is ΔV/N. A nominal voltage difference (ΔV/N) of 21.4 V can convey 20 keV, singly charged ions around the analyzer plate 312 to the exit surface.

For the nine plates 306 shown in each cluster 315 of FIG. 3C, there results 10 channels per cluster (or band). For the 8 energy analyzer clusters (or bands) 315 of the energy analyzer chip, a total potential difference (ΔV) of 235 V is needed. A simple voltage divider network can be used to turn the array of plates into an energy spectrometer with eight distinct energy channels. Keeping one cluster 315 of plates at a potential difference of 235 V and applying decreasing potential differences of 117 V, 58 V, 29 V, 14 V, 7 V, 4 V, and 1 V across the other seven clusters yields nominal pass bands of 20 keV, 10 keV, 5 keV, 2.5 keV, 1.5 keV, 1 keV, 0.5 keV, and 0.1 keV. In this embodiment, each of the 9 relatively high conductive plates 306 of each cluster are electrically floating in between the two adjacent electrodes of the cluster, resulting in a series of voltage drops across the cluster or band.

Figure 8A:
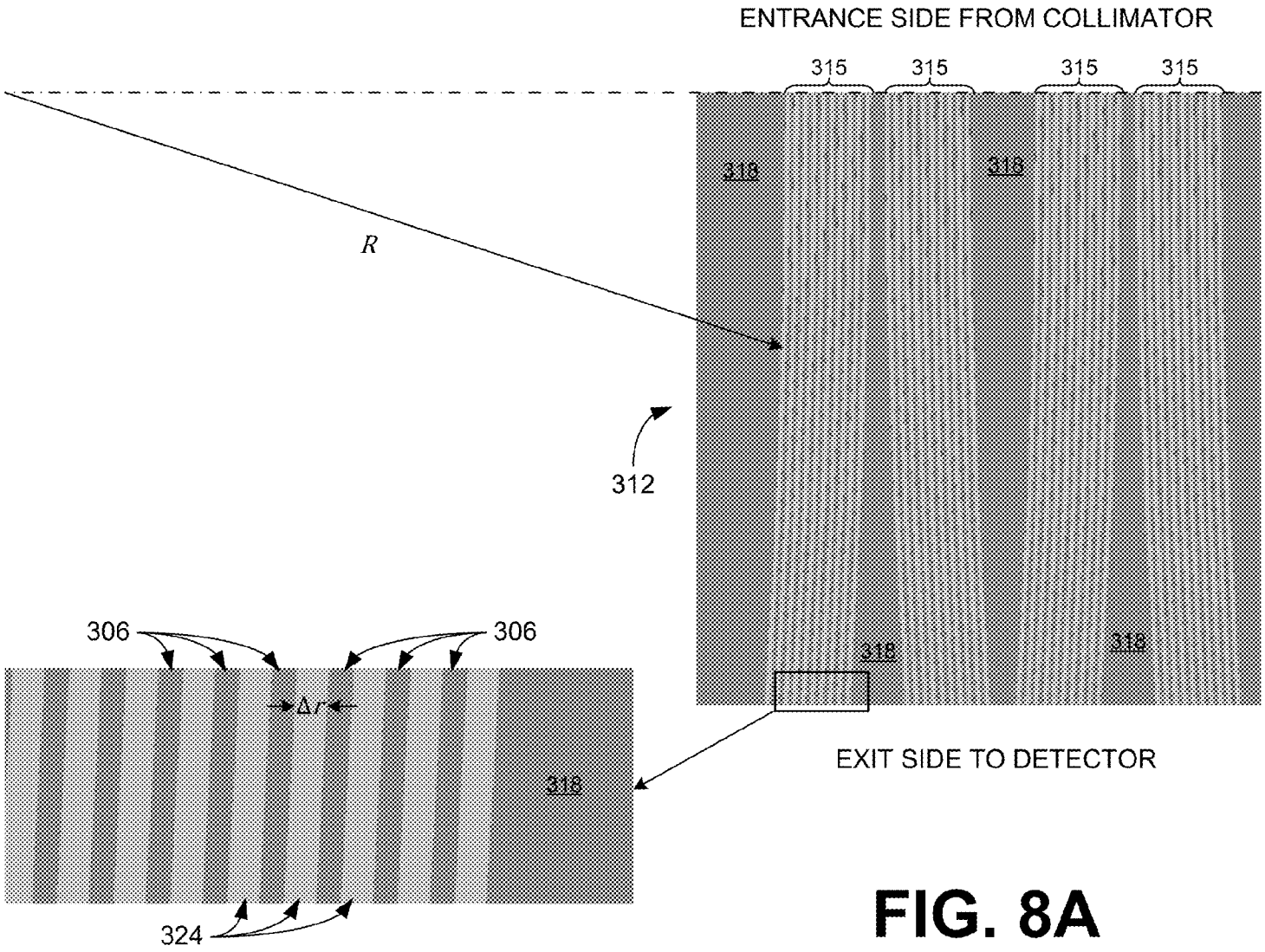
FIGS. 8A and 8B-8C are top and perspective views of an example of an analyzer plate of an energy analyzer array in accordance with various embodiments of the present disclosure.
Figure 8B:
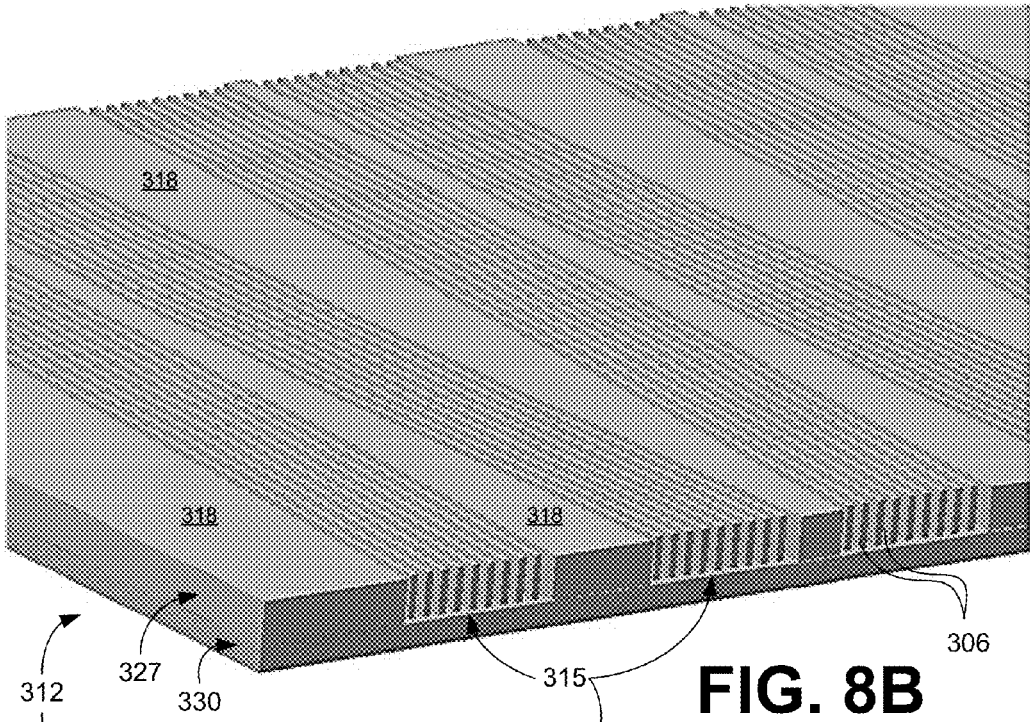
Figure 8C:
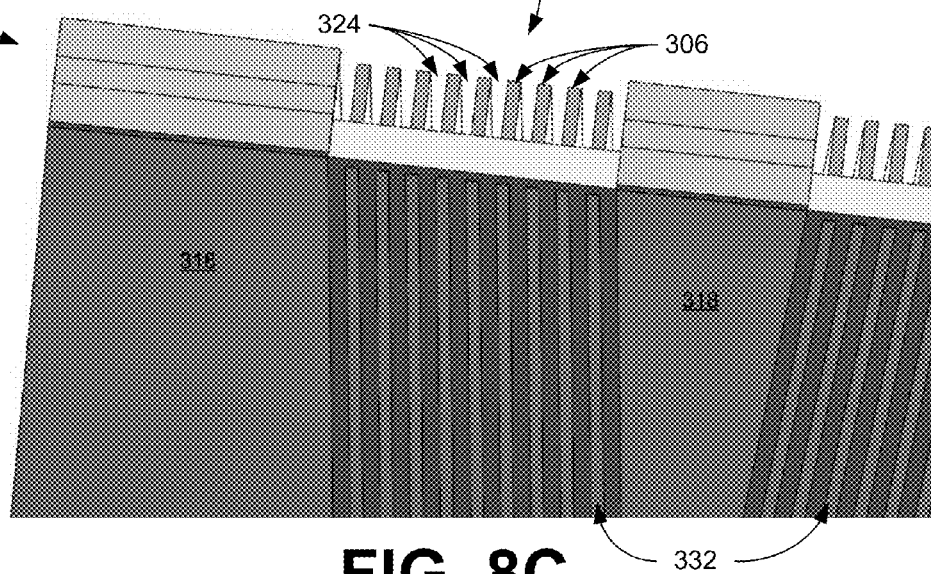
Figure 8D:
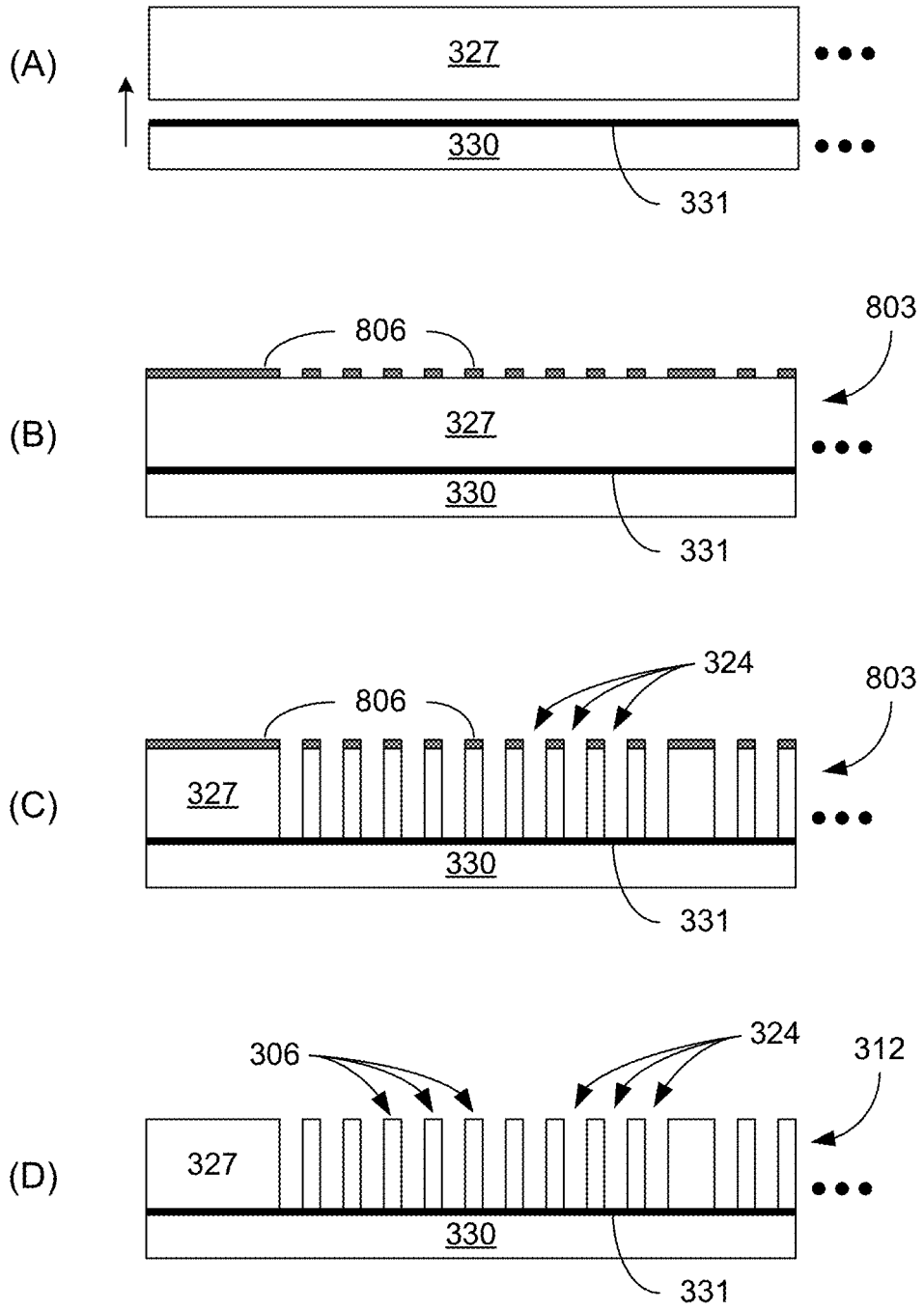
FIG. 8D is an example of fabrication of the analyzer plate of FIGS. 8A-8C in accordance with various embodiments of the present disclosure.

A wafer-scale microfabrication manufacturing approach enables the fabrication of a dense plurality of nested curved plate analyzer channels. It is the ability to nest plates that is the strength of the MEMS-based microfabrication approach. The analyzer wafer (or plate) can be made of a dual wafer stack made from wafer-to-wafer bonding technology. The upper wafer 327 can comprise high conductivity silicon that is bonded to a lower insulating wafer 330. The lower wafer 330 can be made of a lower conductivity silicon with an insulating layer (or surface) 331 adjacent to the upper conductive wafer 327, which is referred to as a silicon-on-insulator or SOI wafer. In alternative embodiments, the lower wafer can be made of an insulating wafer such as, e.g., glass. In either case, the "wafer" being processed is a dual wafer stack with the lower wafer providing both an etch stop and electrical insulation. For the micro-scale analyzer plate 312 shown in FIG. 3C, and which has been realized in a chip as shown in FIG. 8D, each plate is 60 microns wide. The 80 channels in total give a transmission area of 0.2.4 $mm^2$. The total area of the entrance face is 1.175 $mm^2$, giving the overall collection percentage in this realized chip of 22%. As the processing technology moves toward 25 μm or smaller plates (ideally 10 μm), this collection area can approach 40%. or more. A plurality of multiple band energy analyzer chips 312 can be stacked to create a square array of energy analyzer plates with a prototype device being in the 1.5 $cm^3$ range, which is only slightly larger than a sugar cube.

Referring to FIG. 4, shown is a schematic representation of an example of an ultra-compact plasma spectrometer 400 that is rotated to show the uppermost analyzer plate 312. In the example of FIG. 4, twenty-five analyzer plates 312 are stacked atop each other to create an energy analyzer array 403 with a total (square) cross-sectional area of, e.g., 1 cm×1 cm. Although shown in FIG. 4 as simply stacked upon each other, the individual analyzer plates 312 can be mounted in a holding jig to maintain positioning of the analyzer plates 312, or the analyzer plates 312 can be bonded together. With an aperture fraction of 48% for the 1 $cm^2$ cross-sectional area, the collection aperture size of the energy analyzer array 403 (while ignoring the reduction in collection efficiency due to the collimating structure) is about 0.48 $cm^2$. A collimator assembly 203 including, e.g., four collimator plates (chips or wafers) 206 (FIG. 2) is positioned in front of the twenty-five stacked analyzer plates 312 of the energy analyzer array 403. A single detector plate 406 including an 8×8 array of active detector pixels is located after the energy analyzer array 403. While the cross sectional area of the ultra-compact plasma spectrometer 400 of FIG. 4 is 1 cm×1 cm, other cross-sectional areas are also possible.

Detection of ions at energies less than 30 keV is typically accomplished with either discrete channel electron multipliers or microchannel plates. Both approaches utilize high voltage power supplies (about 2 kV to about 3 kV) to create the pulse amplifying electron cascade. The 30 keV ion detection threshold for typical silicon solid state detectors (SSSDs) results from the thickness of the detector contacts and the intrinsic detector capacitance. Incident particles that are not energetic enough to enter the active region of the detection device will not be detected. By lowering the energy threshold for SSSDs, an array of thin-contact, passively cooled, solid state detector pixels can be constructed with a lower energy threshold of only 2 keV for electrons. See, e.g., "Silicon detectors for low energy particle detection" by C. S. Tindall et al. (IEEE Transactions Nucl. Sci., Vol. 55, p. 797 (2008)). SSSDs utilize 100 V or less to operate, have lower background count levels than electron multipliers, and measure all energies simultaneously with a 100% duty cycle.

The low power consumption SSSDs have very thin entrance contacts and an energy threshold of 1.1 keV for electrons and 2.3 keV for ions. When electronic noise is included, this corresponds to a low energy limit of 5 keV for ions. In some cases, thin-contact SSSDs have been able to detect incident hydrogen ions down to energies of 1 keV. The light sensitivity of the SSSDs can be reduced by a factor of 14 in the red portion of the spectrum by depositing a 200 Å thick layer of aluminum on top of the thin contact. Four 2×2 arrays of SSSD detectors can be used to form the single detector plate 406 of FIG. 4, where each detector pixel is 2.5 mm×2.5 mm. When placed behind the energy analyzer array 403, each detector pixel aligns with a specific cluster of the energy analyzer plates 312 (FIG. 3). Therefore, each of the eight vertical groups of detector pixels can yield an eight channel energy spectrum for a fixed analyzer bias voltage. The eight energy spectrum measurements can be summed together to increase the counting statistics. The 2×2 array of pixels is sufficient to differentiate between counts coming from two different analyzer clusters (or bands) 315. Other array configurations of SSSDs may also be utilized for the detector plate 406. The use of energy resolving SSSDs along with energy selection can provide for background rejection.

The particle energy measurement provided by the SSSD is also available for noise rejection of each count. If the energy measured by the SSSD does not fall within with the pass band of the energy analyzer array 403 in front of that SSSD pixel, the count can be rejected. This error-checking counting scheme can substantially reduce background counts from photons and penetrating radiation. The detector electronics and voltage supplies can be located on a single, multilayer circuit board onto which the detector itself is mounted.

Figure 5:
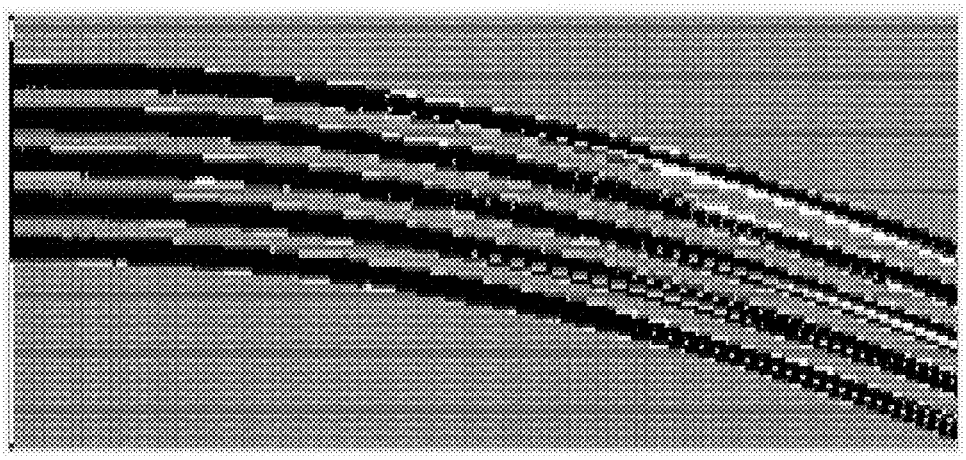
FIG. 5 illustrates 3D SIMION™ simulation results of curved plate analyzers in accordance with various embodiments of the present disclosure.

One figure of merit for a plasma instrument is its geometric factor, i.e., the effective collection area. Too small of a geometric factor and the instrument is unable to generate a statistically significant count rate for the target local plasma conditions. For the ultra-compact plasma spectrometer 400 design shown in FIG. 4, the geometric factor can be given by:

$$G=\Delta\alpha\chi A\gamma\ \mathrm{cm}^2 sr(\mathrm{eV/eV}) \tag{1}$$

where $\Delta\alpha$ is the two-dimensional angular acceptance of the combined collimator assembly (or section) 203 and energy analyzer structure (or section) 403, $\chi$ is the transparency of the collimator assembly 203, A is the total area of the electrostatic energy analyzer 403 apertures, and $\gamma$ is the normalized energy resolution ($\Delta E/E$) of the ultra-compact plasma spectrometer 400. For a given uniform flux of ions incident on the collimator assembly 203, the product of the flux and the geometric factor gives the number of ions that pass through the ultra-compact plasma spectrometer 400 and fall onto the solid state detector 406. A useful expression for estimating the geometric factor of an electrostatic analyzer from the results of a ray-tracing simulation is provided in "Publisher's note: The geometric factor of electrostatic plasma analyzers: A case study from the fast plasma investigation for the magnetospheric multiscale mission" by G. A. Collinson et al. (Rev. Sci. Instrum. Vol. 83, p. 033303 (2012)) as:

$$G=\frac{CA_S E_B\cos^2(\theta_B)\Delta E_B\Delta E_B\theta_B\Delta\phi_B}{NE_0^2}\mathrm{cm}^2\mathrm{sr(eV/eV)} \tag{2}$$

where C is the number of particles from the total of N injected that exit the energy analyzer array 403; $A_S$ is the area of the source region of test particles with average energy $E_B$, average polar angle $\theta_B$ over range $\Delta\theta_B$, and over azimuthal angle range $\Delta\phi$; and $E_O$ is the central passing energy of the analyzer array 403. A 3D SIMION model of a representative section of the energy analyzer array 403 was illuminated with a uniform flux of ions (with random injection angles and across a single channel) and the resultant transmitted fraction was determined. Referring to FIG. 5, shown is the 3D SIMION™ simulation of an analyzer structure with five channels having 40 μm spacing. The simulation illuminated the analyzer structure with 20 keV ions having injection angles spread over ±2° and a uniform spread of energies. The vertical scale has been stretched to make the particle paths easier to see. The transmitted fraction of ions can be used to estimate the geometric factor of the electrostatic energy analyzer. The single channel geometric factor obtained from EQN. (2), and multiplied by 2000 to account for the number of individual analyzers, is $G=3.7\times10^{-5}$ cm$^2$sr(eV/eV).

Figure 6:
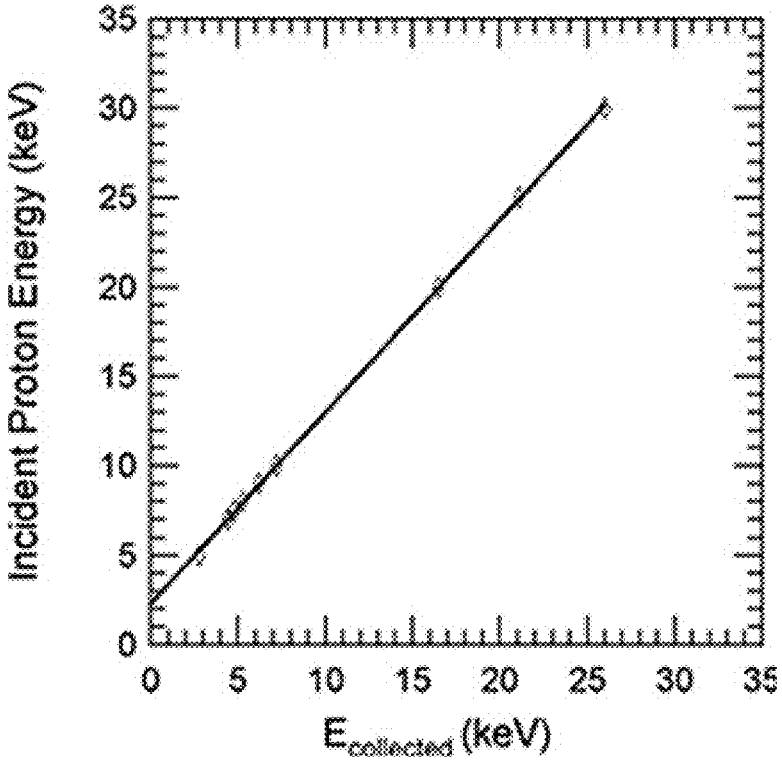
FIG. 6 is a plot of an example of measured proton energy versus incident proton energy for a silicon solid state detector in accordance with various embodiments of the present disclosure.

The measured count rate is a function of the local plasma flux, the geometric factor, and the overall detection efficiency. In a conventional spectrometer, the detection efficiency depends on the conversion efficiency of the microchannel plate or channel electron multiplier as well as the efficiency of the detector electronics. In fact, the conversion efficiency of microchannel plates drops a factor of two over the energy range 1 to 10 keV for protons. SSSDs however, are nearly 100% efficient in detecting ions that make it through the contact layer. Referring to FIG. 6, shown is a plot of an example of measured proton energy versus incident proton energy for a SSSD. As shown in FIG. 6, the energy lost in transiting the contact layer introduces a threshold energy of 5 keV for detection as well as an offset in the proton energy determination from the measured pulse height from the SSSD. Therefore, the overall geometric factor (including detection efficiencies and collimator transparency) of the ultra-compact plasma spectrometer 400 is $G=1.6\times10^{-5}$ cm$^2$sr(eV/eV). For comparison to conventional plasma instruments, the geometric factor should be reduced by a factor of eight to account for the fact that the total incident flux is divided into eight distinct energy bands.

On the other hand, another feature of this ultra-compact plasma spectrometer 400 design is that the device is intrinsically a spectrometer, i.e., multiple energies are measured simultaneously. Whereas in a conventional plasma spectrometer the electrostatic analyzer voltage is swept through a series of fixed voltages, here the entire energy band is continuously sampled. As noted previously, typical duty factors are on the order of 8% so the increased duty-cycle of this spectrometer more than compensates for dividing up the total incident flux into the distinct energy bands.

An ultra-compact plasma spectrometer can be fabricated with wafer scale and chip scale process technologies including, but not limited to, micro-electro-mechanical systems (MEMS) and three-dimensional (3D) chip stacking. For example, silicon based wafer scale micro device process technologies can be utilized to process elements of the ultra-compact plasma spectrometer 400, such as collimator wafers (or chips) 206 (FIG. 2) and energy analyzer plates (wafers or chips) 312 (FIG. 3C). The collimator assembly 203 and energy analyzer 403 of the plasma spectrometer 400 may be referred to as MEMS devices. As such, the collimator wafers 206 and the energy analyzer plates 312 can be made at a wafer (or chip) scale with the use of high aspect ratio silicon etching techniques such as deep reactive ion etching (DRIE) or other appropriate etching technique that can achieve the desired geometry of these elements. Wafer scale fabrication can result in a plurality of collimator chips and/or energy analyzer chips being yielded per wafer. Both of the collimator wafers 206 and the energy analyzer plates 312 include various degrees of high aspect ratio features and hence the choice of silicon-based MEMS processing technologies. Similarly, the detector plate 406 includes one or more solid state silicon detector(s) that can be fabricated using the appropriate chip scale process technologies.

Figure 7A:
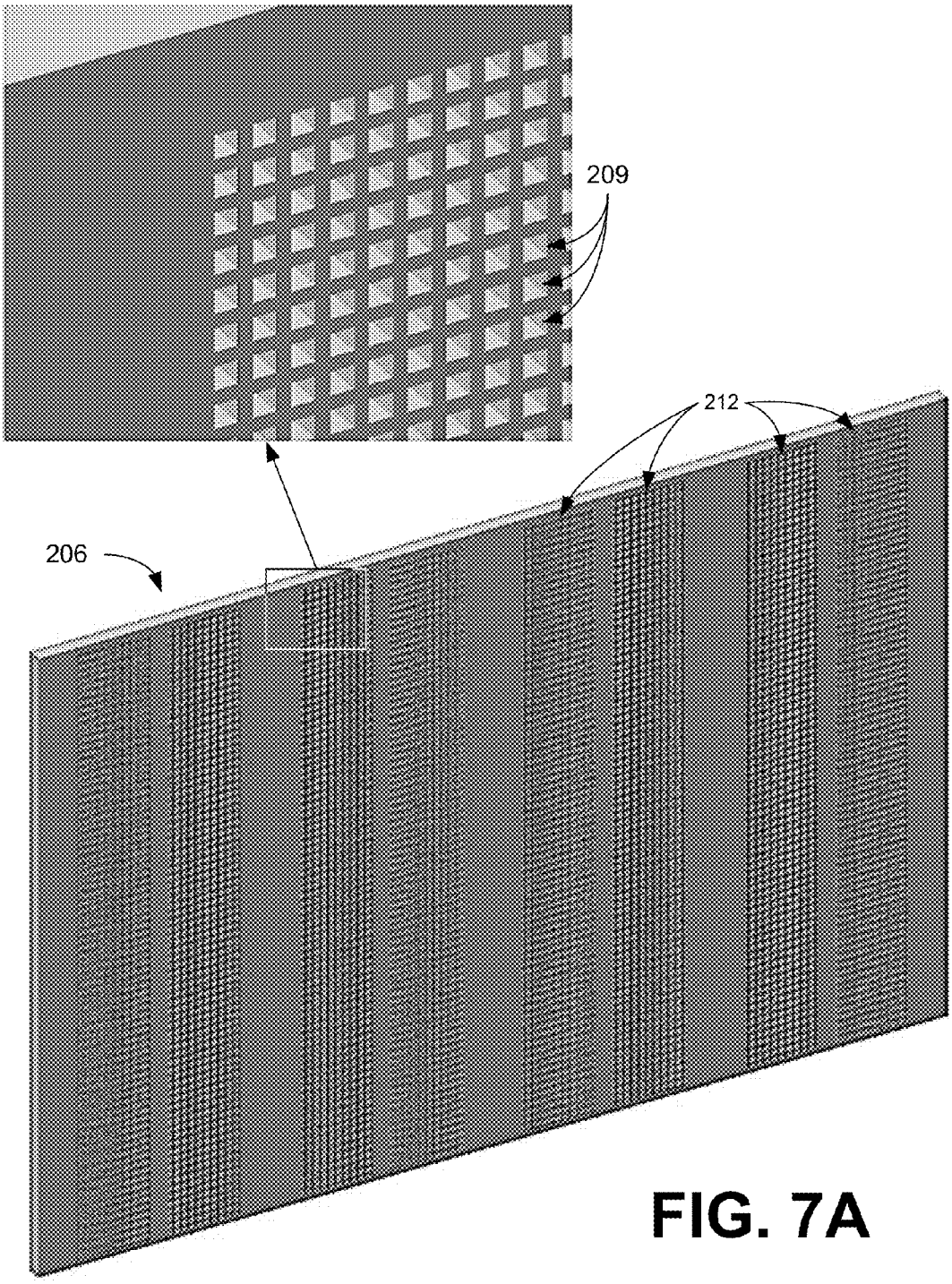
FIG. 7A is a graphical representation of an example of a collimator wafer of a collimator assembly in accordance with various embodiments of the present disclosure.

As previously discussed, the collimator assembly 203 (FIG. 4) passes substantially normal incident particle trajectories to the energy analyzer 403 (FIG. 4). One or more collimator wafers 206 can be used to achieve the needed aspect ratio. Referring to FIG. 7A, shown is an example of a collimator wafer (or chip) 206. The collimator wafer 206 includes a plurality of aperture arrays 212, which correspond with the energy analyzer bands (or clusters) of the energy analyzer 403 (FIG. 4). A portion of one of the aperture arrays 212 is enlarged to illustrate the holes (or apertures) 209 passing through the collimator wafer 206. In the example of FIG. 7A, the apertures 209 are designed for 28 μm×28 μm rectangular holes with a 40 μm center-to-center spacing, that pass through a wafer with a thickness of 320 μm. The features of the collimator wafer 206 can be lithographically defined using DRIE processing with, e.g., a 15:1 aspect ratio. The collimator chip (or wafer) can be fabricated with dimensions that match 3D chip stack of the energy analyzer 403. In some implementations, the collimator wafer 206 can have a nominal 1 cm×1 cm form factor.

Figure 7B:
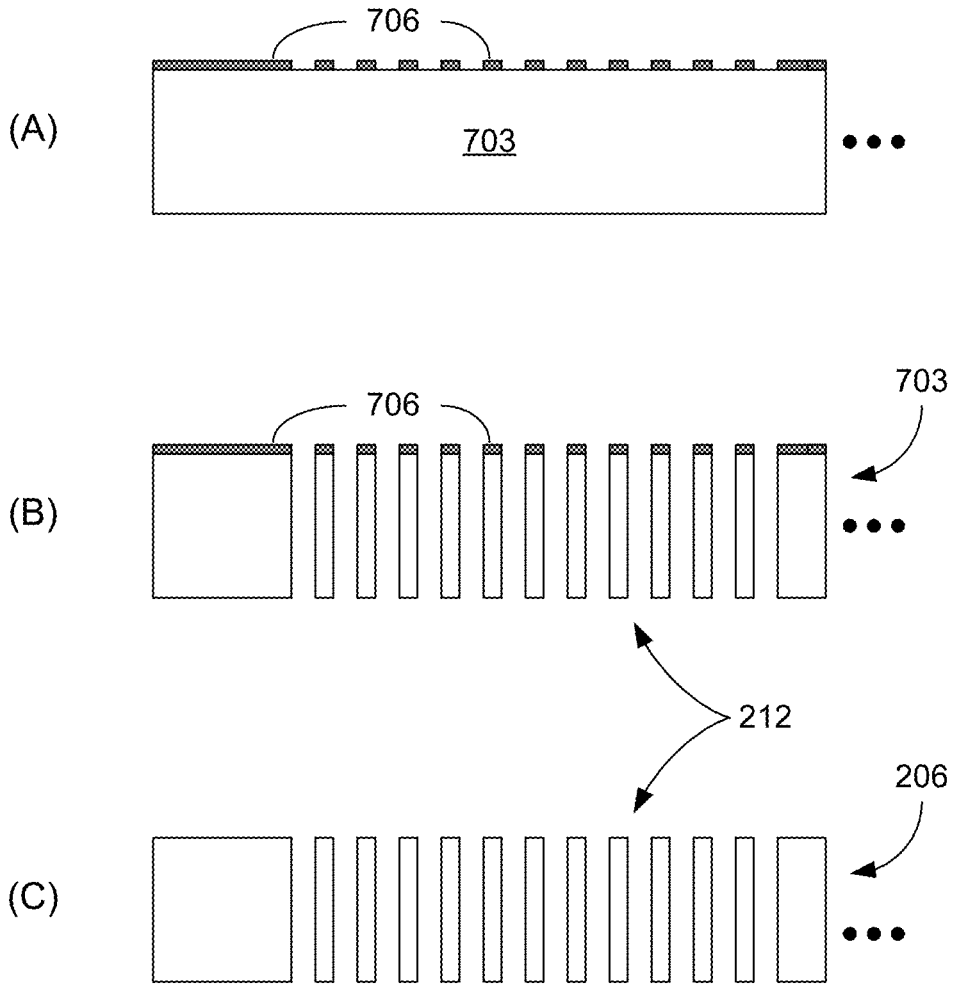
FIG. 7B is an example of fabrication of the collimator wafer of FIG. 7A in accordance with various embodiments of the present disclosure.

Referring now to FIG. 7B, shown is an example of the fabrication of a collimator wafer (or chip) 206 is illustrated over a portion of the wafer. Beginning with (A), a mask pattern 706 is disposed on a surface of the wafer 703. The mask pattern 706 can be formed and patterned using photoresist, a hard mask, or other appropriate process. At (B), the wafer 703 is then etched using, e.g., DRIE or other appropriate etching to form the aperture arrays 212 (FIG. 7A). For example, apertures with an opening width of about 30 μm can be formed through the wafer 703. In some implementations, an aspect ratio of about 15:1 or better can be achieved for a wafer thickness of 320 μm. The mask pattern 706 can then be removed in (C), leaving the collimator wafer 206 for stacking as part of the collimator assembly 203 (FIG. 4).

Figure 7C:
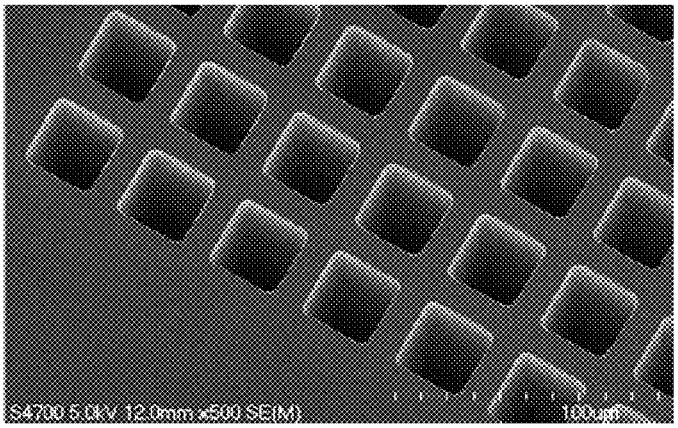
FIGS. 7C through 7F are images of examples of the collimator wafer of FIG. 7A in accordance with various embodiments of the present disclosure.
Figure 7D:
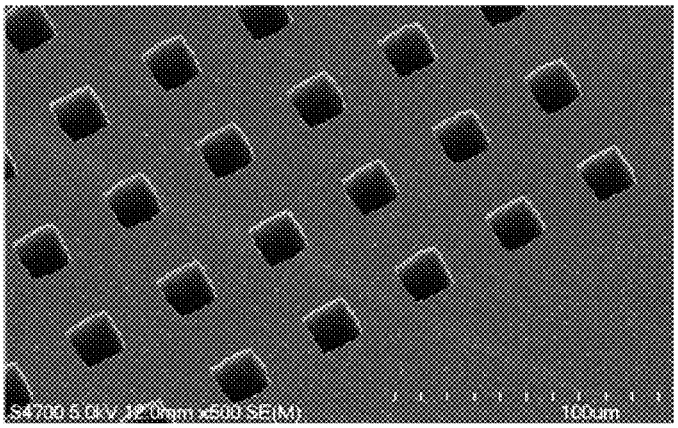

In addition to the relatively high aspect ratio of collimator wafers 206, the transparency to the passage of particles is considered for the collimator assembly 203. A high percentage of transit area versus non-transit area allows for a higher sensitivity of the plasma spectrometer 400 (FIG. 4). For example, a percentage in a range of 40% to 50% (or higher) may be desirable for the application. In the example of FIG. 7A, the collimator wafer 206 was designed with a 50% transparency and a 2°×2° angular acceptance. FIGS. 7C and 7D show SEM images of the entrance side and exit side of a collimator wafer 206, respectively. The etched apertures 209 in the collimator wafer 206 of FIGS. 7C and 7D narrow from 28 μm to about 17 μm after etching through the 320 μm thick wafer. The etching process can be adjusted to reduce or minimize the narrowing effect and other process variations.

A plurality of collimator wafers (or chips) 206 can be stacked to achieve a higher length to area aspect ratio. Due to the limitations of silicon etching technology, collimator chips 206 may be stacked to achieve the aspect ratio for the specified characteristics. While there may exist practical limits to how many collimator chips 206 can be stacked, the use of one collimator chip 206 or the use of two or more stacked collimator chips 206 are within the scope of this disclosure. For example, the use of two stacked collimator chips 206 of FIGS. 7C and 7D can provide a 1.5°×1.5° angular acceptance to provide sufficient collimation.

Figure 7E:
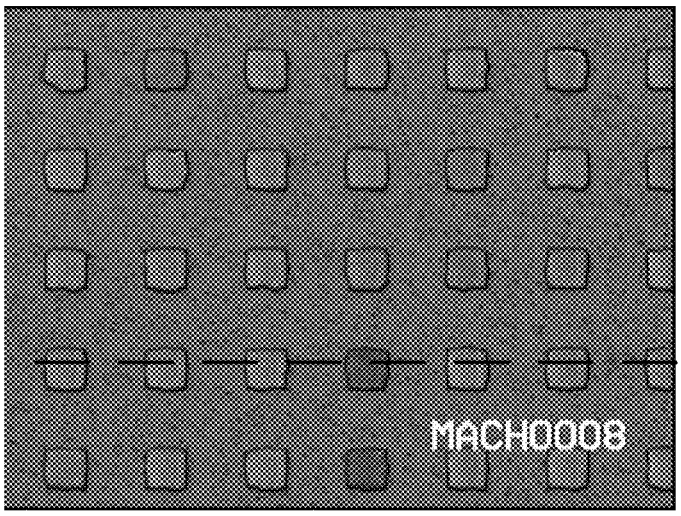
Figure 7F:
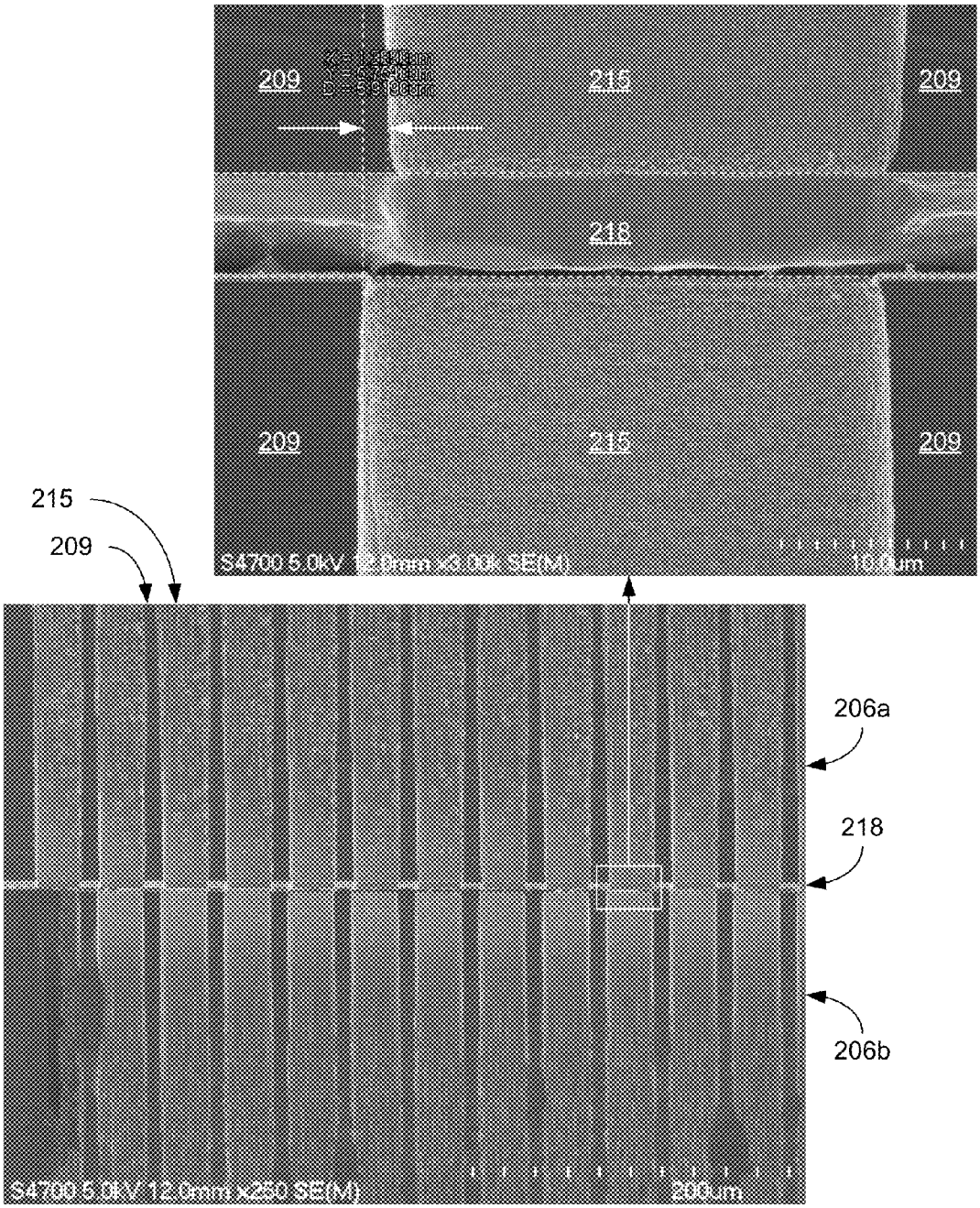

FIG. 7E shows a backlight transmission image of the two stacked collimator wafers 206 illustrating the distribution of the aperture array. This gray scale copy of the original color image indicates excellent transmitted light from the backlight microscope image. A cross-sectional view of the stacked collimator wafers 206 was obtained along fracture line 709. FIG. 7F includes SEM images showing cross-sectional views of two stacked collimator chips 206*a* and 206*b*. The apertures 209 and sidewalls 215 are substantially aligned at a bond interface 218. A portion of one of the bond interface 218 is enlarged to illustrate a post-bond misalignment between the sidewalls 215 of less than 1.5 μm.

The collimator assembly 203 serves to select normal incident particles for passage into the curved plate channels of the energy analyzer 403. As such, other suitable normal incident filters may be used for this application. While the silicon based high aspect ratio, high transparency collimator assembly 203 is utilized in the ultra-compact plasma spectrometer 400, collimator wafers (or chips) 206 and/or collimator assemblies 203 may also be utilized in other technologies such as, e.g., micro-channel plates and/or other micro-scale collimator systems which may operate with the energy analyzer 403.

Particles that have passed through the collimator assembly 203 enter the micro-scale curved channel system the energy analyzer 403. FIG. 8A shows a top view of a portion of an analyzer plate 312 including four energy analyzer bands (or clusters) 315. The energy analyzer wafer 312 can be fabricated with high aspect ratio curved silicon conduction plates 306 which define channels 324 through which the ions of the proper trajectory are passed. These channels 324 are arranged in sets which form the energy analyzer bands (or clusters) 315. In the example of FIG. 8A, each energy analyzer band 315 includes ten channels defined by nine conduction plates (walls or fins) 306 and two adjacent electrodes 318. FIGS. 8B and 8C show perspective views of the analyzer plate 312 of FIG. 8A.

As illustrated in FIG. 8A, the conduction plates 306 are separated with a plate spacing of $\Delta r$ and a curvature that starts normal to the incident ion direction from the collimator assembly 203. The curvature of the conduction plates 306 has a precise radius (R). In the example of FIG. 5, the plate spacing (or channel width) is $\Delta r$=80 μm and the radius is R=300 mm. The trajectory of a normal incident particle having the precise mass-to-charge ratio to pass thought the analyzer channel is the particle that exits to the detector plate 406 (FIG. 4).

The analyzer plates 312 can be lithographically fabricated as chips or wafers. As illustrated in FIGS. 8B and 8C, the analyzer plate 312 can be a wafer-to-wafer bonded stack with a conductive upper wafer 327 and an insulating lower wafer 330 that provides an etch stop. In one embodiment, the conductive upper wafer 327 has a thickness of 350 μm and the insulating lower wafer 330 has a thickness of 200 μm. Analyzer plates 312 may be fabricated with a form factor of 1 cm×1 cm×550 μm thick, with the conduction plates 306 formed as free standing fins or walls with a width as small as 10 μm. Using a 80 μm channel width or plate spacing results in a 90 μm pitch, however different channel widths may be used. This design results in an energy analyzer chip 312 (dual wafer chip) of 1 cm×1.85 cm, which can be attributed to the 60 μm width of the conduction plates 306 and some extra space on each end for handling purposes. The width can be reduced to 1 cm×1 cm goal by reducing the thickness of the conduction plates 306 and removing the extra handling space on each end of the wafer.

Referring now to FIG. 8D, shown is an example of the fabrication of an analyzer plate (or chip) 312 is illustrated over a portion of the plate. Beginning with (A), an analyzer wafer 806 if formed by bonding an upper conducting wafer 327 to a lower insulating wafer 330. The upper wafer 327 can be a high conductivity silicon wafer and the lower wafer 330 can be made of a lower conductivity silicon with an insulating layer (or surface) 331 adjacent to the upper conductive wafer 327, which is referred to as a silicon-on-insulator (SOI) wafer or an insulating wafer such as, e.g., glass or ceramic. At (B), a mask pattern 806 is disposed on a surface of the analyzer wafer 803. The mask pattern 806 can be formed and patterned using photo-resist, a hard mask, or other appropriate process. At (C), the analyzer wafer 803 is then etched using, e.g., DRIE or other appropriate etching to form the conduction plates 306 and channels 324 (FIGS. 8A and 8C). For example, conduction plates 306 can be formed with a width of about 60 μm or less and the channels 324 can be formed with a width of about 80 μm or less. The widths of the conduction plates 306 and channels 324 affect the overall width of the analyzer plate 312. The channels 324 can be etched through an upper wafer thickness of 350 μm. The insulating layer 331 functions as an etch stop as well as providing electrical isolation between the conduction plates 306 and upper and lower wafers 327 and 330. The mask pattern 733 can then be removed in (D), leaving the analyzer plate 312 for stacking as part the energy analyzer array 403 (FIG. 4).

Figure 8E:
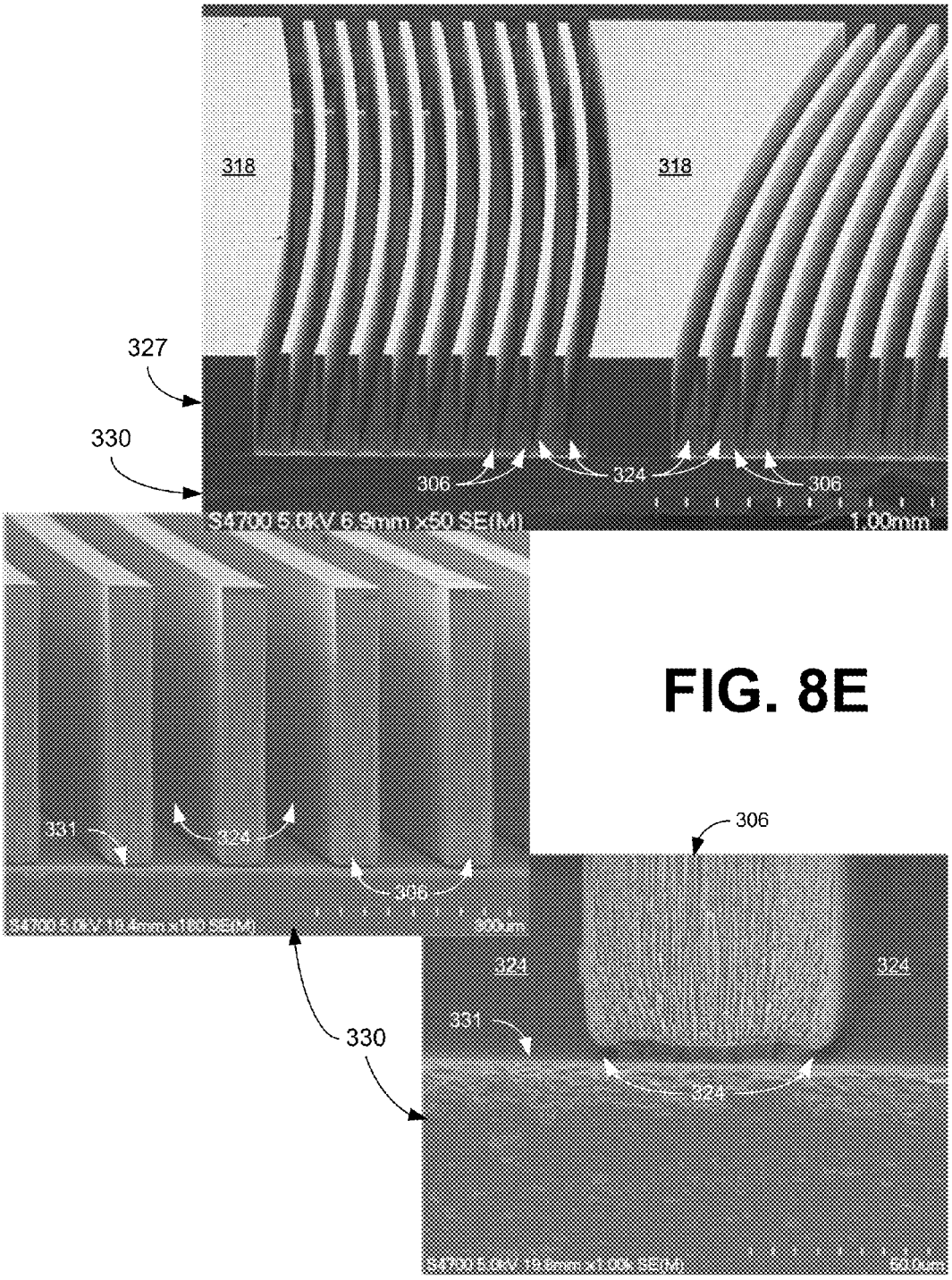
FIG. 8E includes images of examples of the analyzer plate of FIGS. 8A-8C in accordance with various embodiments of the present disclosure.

Referring now to FIG. 8E, shown are SEM images of an example of a fabricated analyzer plate 312. The curvature of the conduction plates 306 is clearly visible in the top image. The conduction plates 306 were fabricated in the conductive upper wafer 327 with a width of 60 μm and separated by 80 μm channels 324. Etching of the conduction plates 306 resulted in an undercut 333 of approximately 5 μm for a thickness of 320 μm. The width of the conduction plates 306 can be reduced to about 30 μm with this undercut 333 and plate depth. Such a reduction in the width of the conduction plates 306 can reduce the width of the analyzer plate 312 to about 1.5 cm. More improvement may allow the same collection area to be fabricated with an analyzer plate width to about 1.2 cm.

Each energy analyzer band 315 is separated from an adjacent energy analyzer band 315 by the electrode 318. With each band of channels having adjacent electrodes 318, each energy analyzer band 315 can be tuned to have unique voltage applied between the electrodes 318, and thereby a different electric field bias in the direction across or perpendicular to the ion trajectory. Thus, a single analyzer plate 312 can include a series of energy analyzer bands 315, each with a unique applied voltage between the electrodes 318 that is adjusted to capture and transmit particles of a certain corresponding mass-to-charge ratios to detectors of the detector plate 406. For example, a 1 cm×1 cm scale analyzer chip 312 can include eight energy analyzer bands 315, each comprising a cluster of ten channels.

In order to improve or maximize the signal-to-noise ratio (SNR) and volumetric efficiency, chip-to-chip stacking technology can be used to make a 3D plasma spectrometer 400 comprising multiple energy analyzer plates 312 stacked upon one another. Referring to FIGS. 8B and 8C, the upper and lower sides of the analyzer plate 312 can be processed to facilitate stacking and interconnection of the electrodes 318 and/or conduction plates 306. For example, backside metal can be included for both chip-to-chip hybridization and electrical connectivity to the underlying layers. Suss FC-150 chip-to-chip hybridizer and custom tooling can be used to bond the chips, with metal alloys providing electrical and mechanical connectivity. Post bond alignments on the order of ±1 μm may be achieved.

Figure 9A:
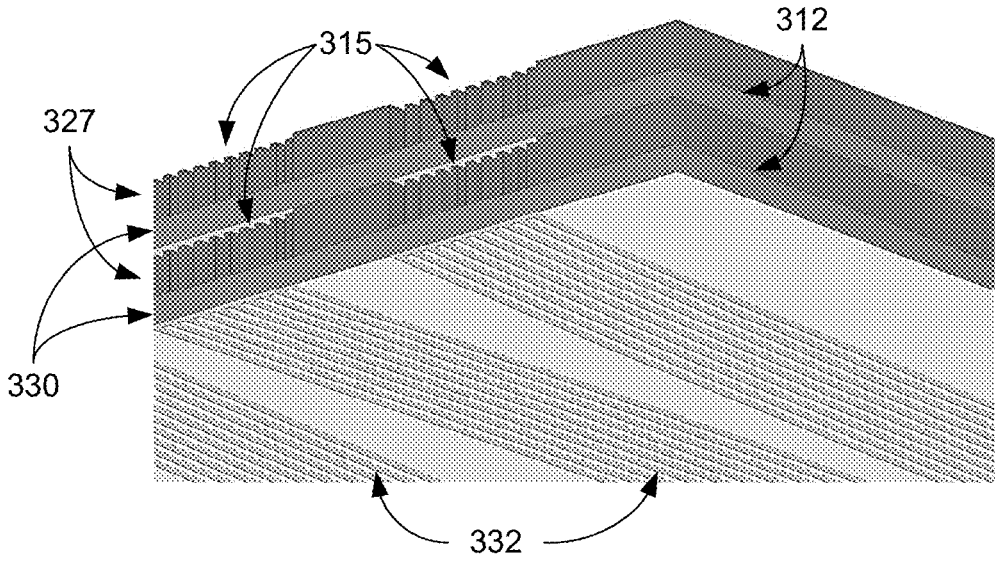
FIGS. 9A and 9B are a graphical representation and an image, respectively, of examples of stacks of analyzer plates of FIGS. 8A-8C in accordance with various embodiments of the present disclosure.
Figure 9B:
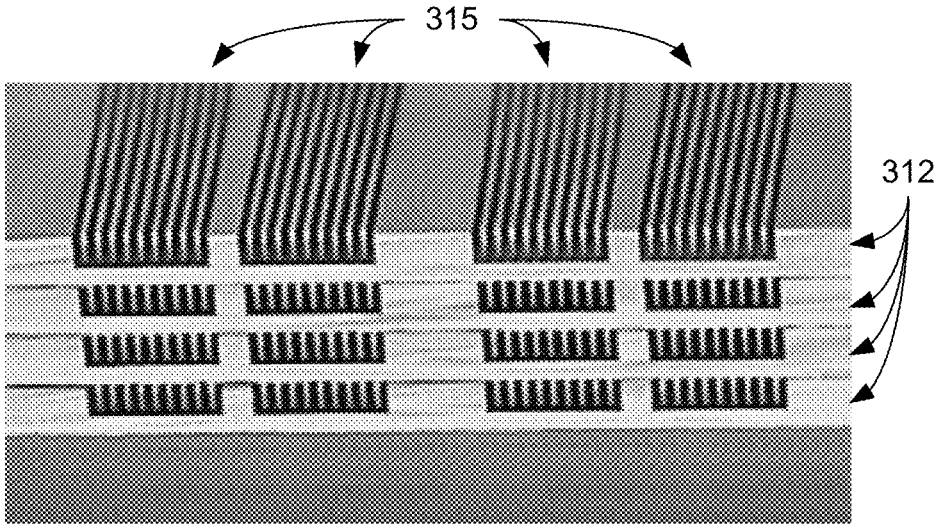

Referring now to FIG. 9A, shown is a perspective view illustrating two stacked energy analyzer plates 312. A connectivity layer 332 allows for electrical and mechanical connectivity between the analyzer plates 312. This can be accomplished with front-side and back-side lithography with the back-side conductive layer being matched to the front-side geometry by the double-side mask aligner. This can achieve a front to back alignment on accuracy on the order of 1 to 2 microns. Front-side conductors, back-side conductors, or combinations thereof can be utilized. In the case of back-side processing, the upper chip carries the electrodes for the lower chip. Electrical interconnects can be integrated into the analyzer plates 312 to facilitate connection between the electrodes 318 and/or conduction plates 306 of adjacent analyzer plates 312. FIG. 9B shows an image of four stacked energy analyzer plates 312.

Figure 9C:
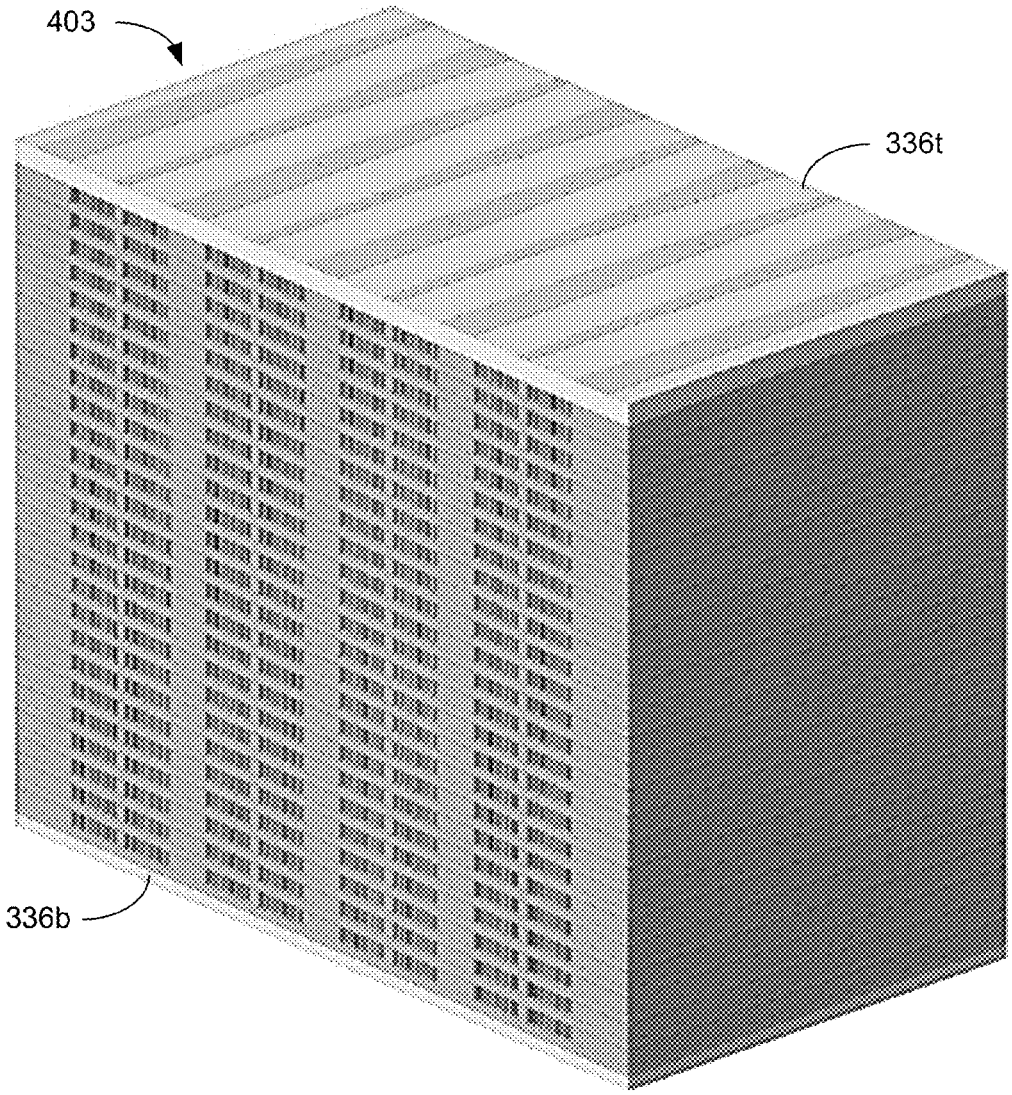
FIG. 9C is a graphical representation of a stack of analyzer plates of FIGS. 8A-8C to form an energy analyzer array in accordance with various embodiments of the present disclosure.

FIG. 9C shows a perspective view of an example of an energy analyzer array 403 comprising a stack of 25 energy analyzer plates 312. It should be noted that a large fraction of the entrance face is active collecting area and each energy analyzer band 315 continuously records 100% of the time. Capacitive coupling can be used to bias the conduction plates 306 within each energy analyzer band (or cluster) 315. A top closure chip 336*t* and/or bottom closure chip 336*b* can provide connection traces for the voltage bias using a thru via approach. The geometric factor for the energy analyzer array 403 having 25 analyzer plates 312 with dimensions of about 1.75 cm×1 cm, each analyzer plate 312 including eight energy analyzer bands 315 with a conduction plate 306 height of 320 μm and width of 60 μm and separated by 80 μm channels was calculated to be $G=3.7\times10^{-5}$ $cm^2sr(eV/eV)$.

Figure 9D:
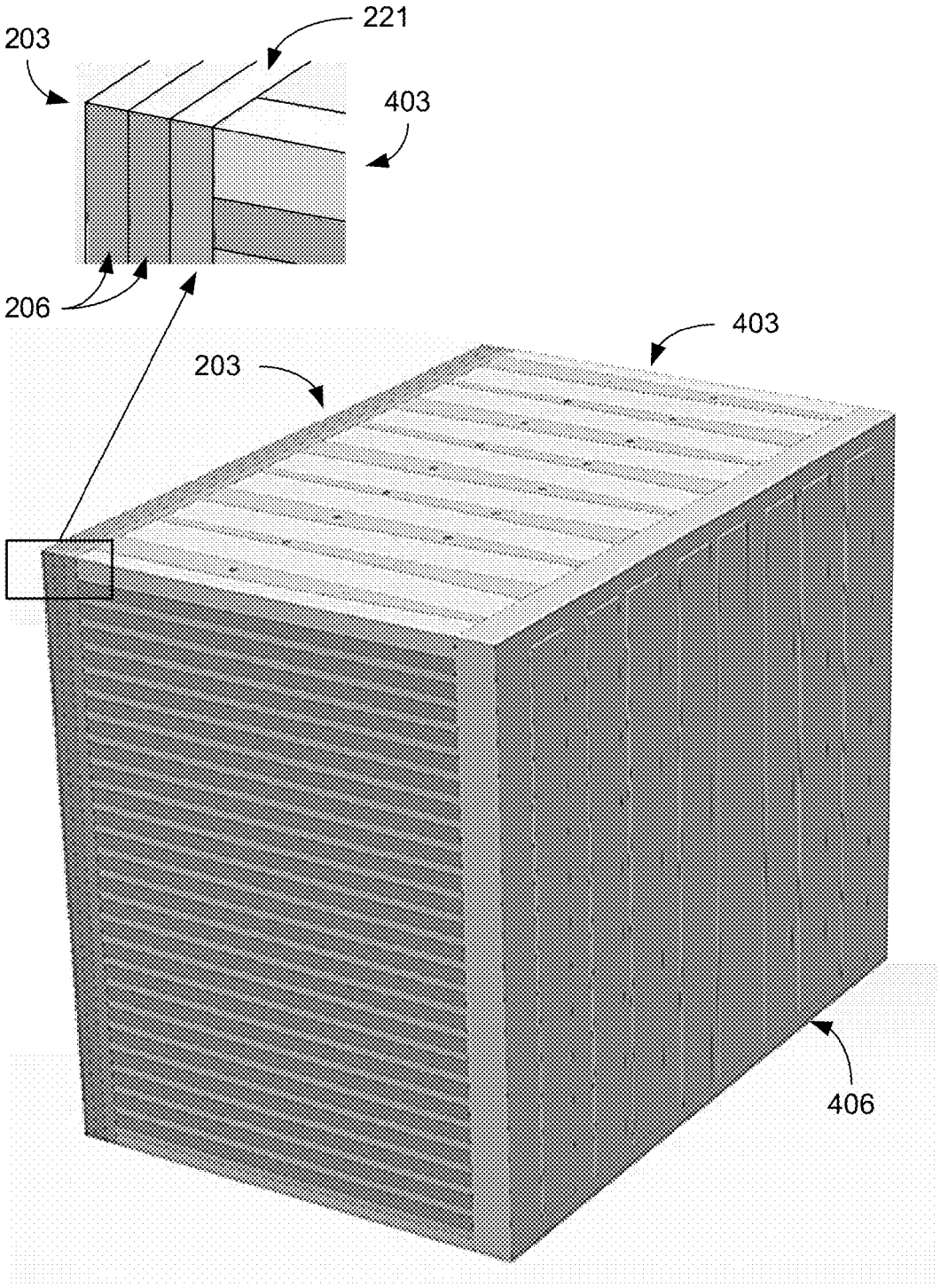
FIG. 9D is a graphical representation of an ultra-compact plasma spectrometer including collimator wafers of FIG. 7A and the energy analyzer array of FIG. 9C in accordance with various embodiments of the present disclosure.

The energy analyzer array 403 can be combined with the collimator assembly 203 and detector plate 406 to form an ultra-compact plasma spectrometer 400, such as the example shown in FIG. 9D. In the example of FIG. 9D, the collimator assembly 203 includes two collimator wafers (or chips) 206 and an interposer chip 221 disposed between the collimator wafers 206 and the energy analyzer array 403. The interposer chip 221 may be thought of as part of the collimator chip stack. The interposer chip 221 can include transmission openings corresponding to the aperture arrays 212 of the collimator wafer 206 (FIG. 7A). In the example of FIG. 9D, the interposer chip 221 includes 8 large transmission openings corresponding to the 8 collimator bands (aperture arrays) 212 of FIG. 7A and, adjacent to the transmission openings, it can contain a vertical conductive strip of a metal film such as gold or indium which can serve to connect the electrodes 318 (FIG. 8A) of each energy analyzer chip 312 in the energy analyzer array 403. Such a configuration can provide a 2°×2° angular acceptance. The detector plate 406 can include SSSD sections that correspond to the energy analyzer bands 315 of the energy analyzer array 403. In this way, a plurality of energy bands can be simultaneously measured with a nominal energy range of 5 keV to 20 keV. A fast plasma instrument can be produced with $G=2\times10^{-4}$ $cm^2sr(eV/eV)$ per angular pixel at 20 keV. The instrument can be linearly scaled with each instrument dimension. In some implementations, a nominal form factor of 1 cm×1 cm×1 cm can be implemented.

Integrated silicon MEMS processing technology can be used in combination with 3-dimensional chip stacking technology to achieve a high volumetric efficient, low power compact mass-to-charge ratio sensor. In one embodiment, a collimator assembly 203 can be mated to the energy analyzer assembly 403, and the detector plate 406 including solid state silicon detectors (SSSDs) may then be mated to the MEMS based system to form an ultra-compact plasma spectrometer 400. The entire integrated device may be assembled in various ways or order, and the above description is not meant to be limiting in any way. The goal of the disclosure is to use fully integrated micro-electronic and MEMS based processing to achieve a high volumetrically efficient and low power device. Furthermore, the various sections of the channels of the energy analyzer 403 may be provisioned with electric fields and/or magnetic fields to discriminate various trajectories and mass-to-charge ratios in accordance with the principles of various ion and mass spectrometers.

One embodiment, among others, comprises a 25 chip stacked energy analyzer array 403. Using the implementation, it is possible to achieve an instrument with a form factor on the order of 1 cm×1 cm×1 cm (1 $cm^3$). It should be noted that any number of channels may be utilized in the energy analyzer bands 315. Likewise, as noted elsewhere in this disclosure, the energy analyzer 403 can be used alone or in combination with a collimator assembly 203, and may be used on combination other detection systems. The plasma spectrometer 400 is a fully solid state instrument that offers resilience to impact, vibration and environmental conditions. The geometric factor allows for linear scaling such that a gain factor of 10 in sensitivity can be achieved by setting 10 instruments side-by-side. 20 keV particles can be measured with a voltage in the range of 100 to 200 Volts and without the use of a microprocessor. The use of wafer and chip fabrication processes allows for manufacturing scalability (e.g., about 12 units per 100 mm wafer, about 48 units per 200 mm wafer) with defective elements or instruments being discarded.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. An ultra-compact plasma spectrometer, comprising:

a collimator assembly;

an energy analyzer array that receives charged particles from the collimator at a first side of the energy analyzer, the energy analyzer array comprising a plurality of analyzer plates having distinct energy channels, where individual energy channels of the distinct energy channels comprise a plurality of parallel curved conducting plates extending across one of the plurality of analyzer plates from the first side of the energy analyzer to a second side of the energy analyzer that is opposite the first side; and a detector plate that detects charged particles exiting the second side of the energy analyzer array.

2. The ultra-compact plasma spectrometer of claim 1, wherein the plurality of analyzer plates are stacked.

3. The ultra-compact plasma spectrometer of claim 2, wherein individual ones of the plurality of analyzer plates include a plurality of distinct energy channels.

4. The ultra-compact plasma spectrometer of claim 1, wherein the distinct energy channels comprise nine parallel curved conducting plates.

5. The ultra-compact plasma spectrometer of claim 1, wherein individual conducting plates of the plurality of parallel curved conducting plates have a thickness of 60 μm or less and are spaced apart by 80 μm or less.

6. The ultra-compact plasma spectrometer of claim 1, wherein the plurality of parallel curved conducting plates have a curve radius to plate spacing ratio ($R_1/\Delta r$) of 3,750.

7. The ultra-compact plasma spectrometer of claim 1, wherein the energy analyzer array comprises a stack of 25 analyzer plates, each analyzer plate comprising eight energy channels.

8. The ultra-compact plasma spectrometer of claim 1, wherein the collimator assembly comprises a plurality of wafers having aligned arrays of apertures.

9. The ultra-compact plasma spectrometer of claim 8, wherein the plurality of wafers comprise single crystal silicon wafers.

10. The ultra-compact plasma spectrometer of claim 8, wherein the apertures comprise an entrance opening that is substantially rectangular with a dimension of about 50 μm×50 μm or less.

11. The ultra-compact plasma spectrometer of claim 1, wherein the detector plate comprises an array of silicon solid state detectors (SSSDs).

12. The ultra-compact plasma spectrometer of claim 11, wherein the array of SSSDs detects ions with an energy level of 5 keV or less.

13. The ultra-compact plasma spectrometer of claim 1, further comprising a power supply that energizes the distinct energy channels of the plurality of analyzer plates.

14. The ultra-compact plasma spectrometer of claim 13, wherein the distinct energy channels of one of the plurality of analyzer plates is energized at different voltage levels.

15. The ultra-compact plasma spectrometer of claim 1, wherein individual plates of the plurality of analyzer plates comprises a conductive layer disposed on an insulating layer, where the distinct energy channels are formed in the conductive layer.

16. A method, comprising:

bonding a stack of analyzer plates to form an energy analyzer array, where individual analyzer plates comprise a plurality of energy analyzer bands extending from an entrance surface to an exit surface of the energy analyzer array;

affixing a collimator assembly to the entrance surface of the energy analyzer array, the collimator assembly comprising a plurality of aperture arrays configured to align with the plurality of energy analyzer bands; and affixing an array of detectors to the exit surface of the energy analyzer array, the array of detectors aligned with the plurality of energy analyzer bands.

17. The method of claim 16, comprising forming the plurality of energy analyzer bands in the individual analyzer plates, individual energy analyzer comprising a plurality of channels defined by one or more curved conducting plates and a pair of electrodes.

18. The method of claim 17, comprising:

bonding a conductive wafer to an insulating wafer, the insulating wafer comprising an insulating layer disposed on a surface adjacent to the conductive wafer; and etching the plurality of channels in the conductive wafer to form the energy analyzer bands in the individual analyzer plates.

19. The method of claim 16, comprising etching apertures through a collimator wafer to form the plurality of aperture arrays.

20. The method of claim 19, comprising bonding the collimator wafer to a second collimator wafer to form the collimator assembly, where apertures of the plurality of aperture arrays of the collimator wafer are substantially aligned with apertures of a plurality of aperture arrays of the second collimator wafer.

* * * * *